United States Patent [19]

Fejmert

[11] 4,165,185

[45] Aug. 21, 1979

[54] MIXER, PREFERABLY FOR THE MIXING OF CONCRETE

[76] Inventor: Bernhard V. Fejmert, Nordostpassagen 19, 413 11 Göteborg, Sweden

[21] Appl. No.: 878,908

[22] Filed: Feb. 17, 1978

[30] Foreign Application Priority Data

Feb. 17, 1977 [SE] Sweden ..... 7701748

[51] Int. Cl.[2] ..... B01F 7/18; B28C 5/16

[52] U.S. Cl. ..... 366/65; 285/235; 366/67; 366/169; 366/309

[58] Field of Search ..... 366/65, 67, 40, 64, 366/169, 309, 312; 285/114, 118, 235, 236, 283

[56] References Cited

U.S. PATENT DOCUMENTS

| | | | |
|---|---|---|---|
| 1,791,880 | 2/1931 | Tuck | 366/67 |
| 1,811,719 | 6/1931 | Johnson | 366/67 |
| 2,717,147 | 9/1955 | Fejmert et al. | 366/65 |
| 2,784,989 | 3/1957 | Krupp | 285/236 |
| 3,020,029 | 2/1962 | Fejmert | 366/65 |
| 3,168,296 | 2/1965 | Cowley | 366/65 |
| 3,456,926 | 7/1969 | Hummelshoj | 366/65 |

FOREIGN PATENT DOCUMENTS

| | | | |
|---|---|---|---|
| 1445298 | 8/1976 | United Kingdom | 285/163 |

*Primary Examiner*—Harvey C. Hornsby
*Assistant Examiner*—John M. Jillions

[57] ABSTRACT

A mixer for mxing concrete and comprising an annular mixing tub. A rotor is situated at the center of the mixing tub above the same. The rotor is rotatable by means of driving means and carrying agitating means including a number of agitators. They extend down in the mixing space of the mixing tub and are provided with means for feeding of liquid to the mixture. The rotor has the shape of a preferably circular case with its outer border extending substantially to the inner border of the annular mixing tub and including an inner space. The periphery of the case carries a number of tubular arms each extending substantially in a radial direction and carrying said agitators with said inner space in the center of the case in connection with conduit means for the supply of liquid and by means of said respective tubular arms to the liquid feeding means of the agitators.

The rotor includes between the arms and the agitators a pivoting means comprising a resilient rubber element, normally holding the agitators in a normal working position, but allows the agitators to pivot when encountering high resistance.

7 Claims, 4 Drawing Figures

MIXER, PREFERABLY FOR THE MIXING OF CONCRETE

The present invention relates to a mixer, preferably for the mixing of concrete and comprising an annular tub. Situated in the centre of the mixing tub and above the same is a rotor means rotatable by means of driving means and carrying agitating means including a number of agitators extending down in the mixing space of the mixing tub and provided with means for feeding of liquid to the mixture.

Mixers of this type are known for example from the Swedish patent specification No. 326 911. Such mixers comprise an annular mixing tub with a horizontal bottom. A bearing means for a rotor carrying a number of agitators is positioned in the centre of the mixing tub. Due to the rotation of the rotor the agitators move in the annular tub. During the mixing operation water is supplied and it is thereby known to direct the water down to the agitators and bring it to flow out from the same. For this purpose the rotor is provided with a water supply means placed upon the rotor. In order to avoid that too heavy stresses will occur if the agitators are affected by a large resistance e.g. from larger pieces of the ballast in the concrete the rotor is provided with bearing and resilient means for the carrying of the agitators.

Known mixers of this type in practice have some disadvantages. Thus, the rotor has a very complicated design as the same has to included said bearings and resilient means for the agitators which also are difficult to get access to for maintenance. Further the maintenance of the rotor is very difficult as the same has a high weight as well as large dimensions owing to the complicated design and due to the fact that a reduction gear is situated in the rotor. The water supply means placed upon the rotor and provided with a great number of tubes which have to be articulated usually by means of hoses and connectable to a water supply conduit by means of a swivel coupling further complicates the design and involves still more difficulties for maintenance. The height of the mixer is considerable due to the bulky rotor arrangement and the bulky water supply means upon the same. This fact in turn means that the housing of the mixer which is a requirement based on the efforts to reach a better working environment has large dimensions and has to be arranged to include the tube arrangement rotating together with the rotor which by its position within the rotor is exposed to splashes of concrete. This results in turn in cleaning difficulties and the risk of damage of the water supply means.

The present invention has for its object to eliminate said disadvantages by means of an agitator mixer comprising a very simple rotor with small dimensions which is integrated with a water feeding means resulting in a minimum height mixer unit which is easy to clean.

Another object of the present invention is to provide such a design for the bearings and resilient means of the agitators that said simple minimum height embodiment is made possible.

A further object of the invention is to provide such bearings, resilient means and water feeding means for the agitators that hoses, which are easy to damage are not necessary.

According to the invention the rotor means has the shape of a preferably circular case with its outer border extending substantially to the inner border of the annular mixing tub and including an inner space, said border of the case carrying a number of tubular arms each extending substantially in a radial direction and carrying said agitators with said inner space in the centre of the case in connection with conduit means of the supply of liquid and by means of said respective tubular arms to the liquid feeding means of the agitators.

In the enclosed drawings an embodiment of the invention is shown which embodiment is described more in detail in the following.

Figure 1:
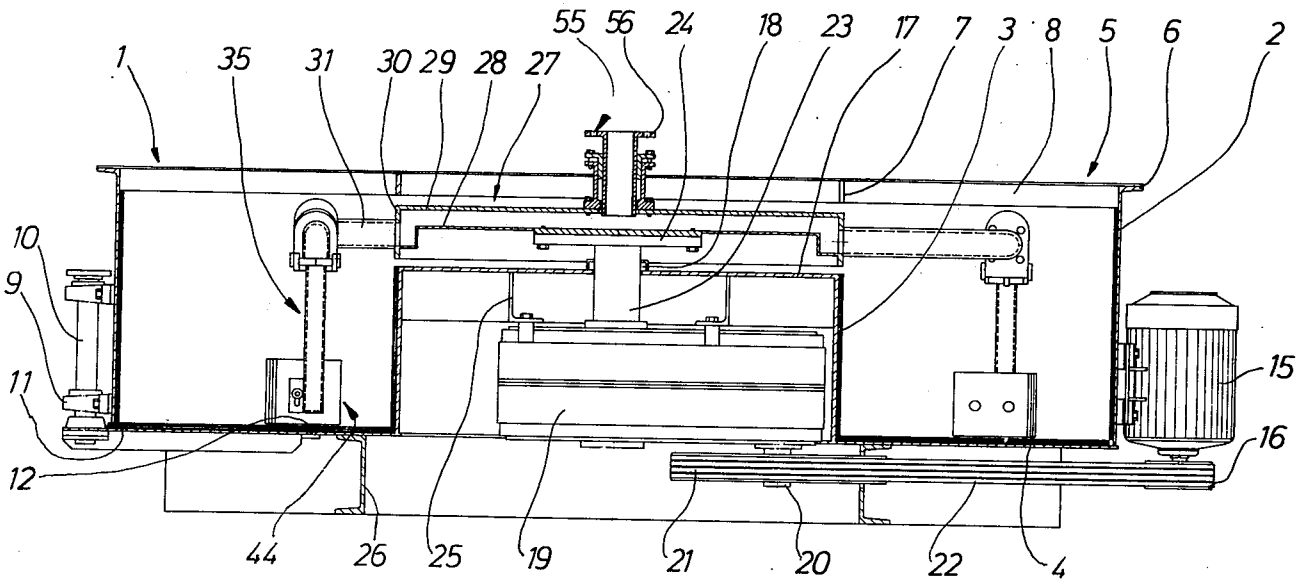
FIG. 1 shows a vertical sectional view of the mixer.
Figure 2:
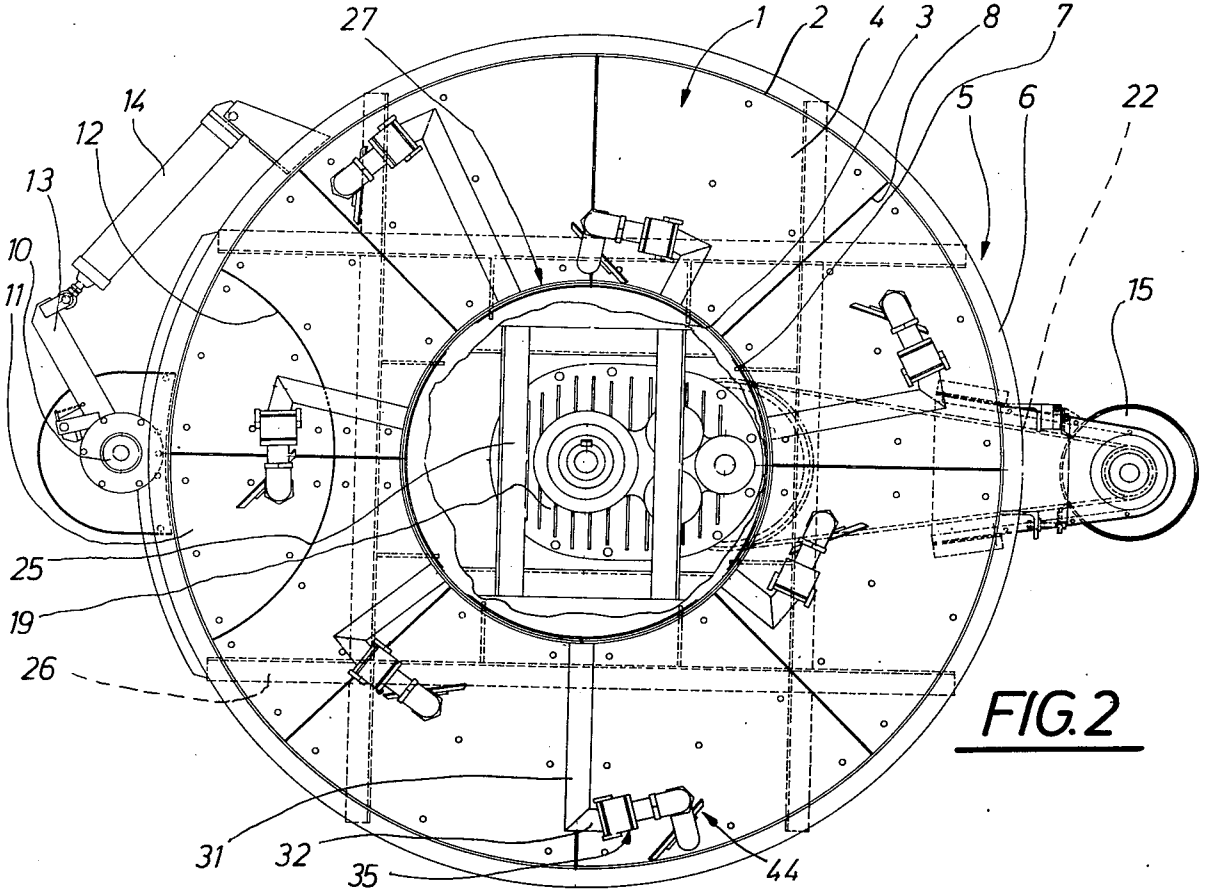
FIG. 2 shows a view from above of the mixer.

According to FIGS. 1 and 2 an annular mixing tub 1 comprises an outer cylindrical wall 2, an inner cylindrical wall 3 and a bottom 4. The outer wall 2 is terminated by a frame with an outer border 6, an inner border 7 and intermediate struts 8. The outer side of the outer wall 2 carries two bearing houses 9 in which a shaft 10 is pivotable. The shaft carries at its lower end a shutter 11 in the form of a segment which is fitted in a correspondingly shaped opening 12 in the bottom 4. The shaft 10 carries according to FIG. 2 a lever 13 which is pivotable by means of a hydraulically or pneumatically actuable power unit 14. By pivoting the shaft 10 by means of the power unit 14 the shutter thus can be brought either to close the opening 12 in the bottom 4 or to be pivoted away from the same so that an opening for the discharge of the tub is provided.

Opposite to the described shutter arrangement on the outer wall 2 an electrical motor 15 provided with a groove pulley 16 is attached on the end of its vertical shaft which is directed downwards. The groove pulley 16 is positioned below the level of the bottom 4. The motor 15 is preferably pivotably mounted for belt tightening purpose, see FIG. 2.

The cylindrical inner wall 3 is provided with a cover 17 with a sealing ring 18 in its centre. In the downwards open space formed by the wall 3 and the cover 17 a reduction gear 19 is placed. The input shaft 20 is provided with a groove pulley 21 in line with the groove pulley 16. The groove pulleys 16 and 21 are connected by means of a number of V-belts 22. The output shaft 23 of the reduction gear 19 extends through the sealing ring 18 and to the upper side of the cover 17 and carries at this portion a coupling flange 24. The standard type attached directly to a stub shaft could be used as a reduction gear. For the purpose of carrying the reduction gear 19 in the space for the same a number of beams 25 is arranged. The reduction gear is attached to the beams by means of screws. The bottom 4 of the mixing tub 1 is at its underside provided with further beams 26 which are intended to rest against a base or a supporting frame. In one of the beams 26 an opening for the belts 22 is provided.

According to the invention the flange 24 of the shaft 23 carries a flat cylindrical case 27 comprising the rotor means and consisting of an underplate 28, an upper plate 29 and an outer wall 30 connecting the plates. At the outer wall 30 a number of tubes 31 is attached extending radially to the case. Said tubes are of different length according to FIG. 2. The tubes 31 are by means of holes in the wall 30 connected to the inner space of the case 27.

The tubes 31 terminate each in an end tube 32 extending substantially perpendicular to the respective tube 31. Each tube 31 terminates with a flange 33 with screw holes and at each side a bearing bracket 34 which is apparent from FIG. 3.

Figure 3:
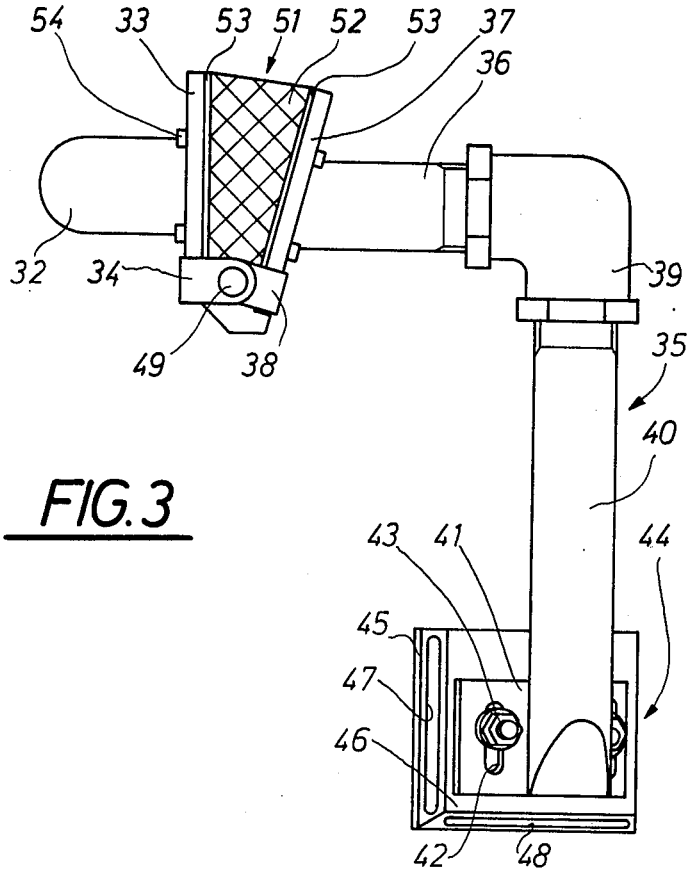
FIGS. 3 and 4 show an agitator with an arm belonging to the same in a side view and a view from above in an enlarged scale compared to the scale in FIGS. 1, 2.
Figure 4:
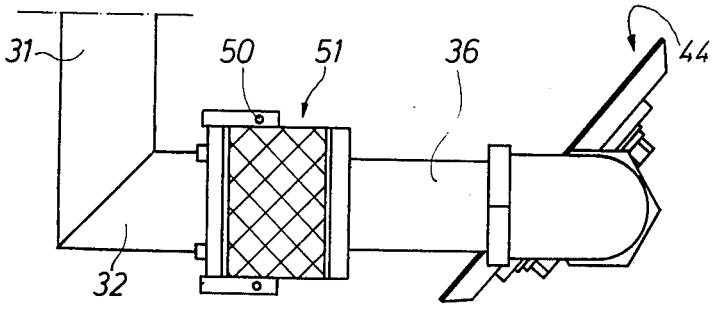

From FIGS. 3 and 4 it is apparent that the agitator means 35 of the mixer consists of a first tube 36, which carries a flange 37 with holes and at each side a bearing bracket 38. The tube 36 is by means of a knee shaped piece 39 connected to a second tube 40 carrying a flange 41 with two slots 42. The tube 40 is closed at its end but has an outlet in its side by means of a hole in the flange 41 attached to the tube. The flange 41 is in turn provided with a screw arrangement 43 for carrying an agitator 44. The agitator 44 consists of a front plate 45 and a back plate 46. The latter one is adapted to be attached to the flange 41. The plates are connected by means of side walls having an oblique angle. Two of the side walls are provided with slots 47 and 48 through which a space between the plates 45 and 46 has an outer connection. Said space is also connected to the attaching surface for the flange 41 through a hole in the plate 46. By means of this arrangement the slots 47 and 48 are connected to the tube 36 via the tube 40 and the knee shaped piece 39.

Both flanges 33 and 37 are adapted to be connected in a pivoting arrangement by means of a shaft 49 extending through the bearing brackets 34 and 38. The shaft is attached to the brackets by means of pins 50. The flanges are so attached that they diverge as seen from the bearing. In order to fill up the space between the flanges an intermediate body 51 is provided consisting of a rubber element 52 onto which two steel flanges 53 are vulcanized. The steel flanges 53 have holes for screws corresponding to said holes in the flanges 33 and 37 and it is thus possible to attach them by means of screws 54. When not attached the intermediate body 51 has an angle corresponding to the angle between the flanges 33 and 37 which means that it is easy to push a piece down between the flanges by moulding the same without the need of a demounting of the shaft 49. The flanges 33, 37 as well as the intermediate body 51 are provided with a penetrating hole respectively.

According to FIG. 1 the plate 29 of the case 27 in its centre carries a swivel coupling 55 to the outer flange 56 of which the conduit for the supply of water is intended to be attached. This conduit communicates accordingly via the coupling 55, the space in the case 27, the tubes 31 and 32, the intermediate piece 51, the tube 36, the knee shaped piece 39, the tube 40 and the agitator 44 with the slots 47 and 48 which thus form outlet openings for the water. It should be noted that the centre portion of the case 27 is broken in FIG. 2, making the reduction gear 19 visible.

Further it should be noted that the frame 5 forms one central and numerous peripheral openings which are easy to cover with separate plates or cloths which are easy to handle. It is known to use elastic rubber sheets which are easy to adapt. One or some of the peripheral openings will have to be uncoverable so that an opening for the filling of the material is provided.

When the mixing operation has to be performed the electric motor 15 is started bringing the output shaft 23 to rotate clockwise (seen in FIG. 2) with the rotational rate reduced in the belt transmission 16, 21, 22 and in the reduction gear 19. Due to the rotation the case 27 and consequently also the agitator means 35 are brought to rotate via the flange 24. The dry ingredients which have to be mixed are supplied from above through said filling openings at which time the shutter 11 has to be closed. The ingredients are now mixed with each other by agitating by means of the movement of the agitators 44 through the mass. During the mixing water and/or vapour is supplied and possibly other ingredients which are mixable with the water which is provided by means of said water supply conduit through the case 27 and the mentioned path out through the slots 47, 48 of the agitators. The agitators are adjustable with respect to the distance from the bottom 4 by means of the screw arrangements 43. By a suitable adaption of this distance and of the angular position and the design of the agitators a careful mixing of the ingredients is effected during a good distribution of water through each one of the agitators. The discharge is effected through the shutter 11. During operation the agitators are subjected to large forces. However, said forces will be absorbed by means of resilience by the fact that the agitators 44 with the tubes 40 and 36 can pivot backwards around the shafts 49. This will occur under a springing movement in the rubber element 52 of the intermediate body 51 by which a damping effect is obtained with a suitable choice of material.

As is evident from the specification and the drawings the mixer according to the invention can achieve a small height compared to prior known mixers and it is very suitable to be enclosed in a housing. The parts exposed to the mixing compound are of a very smooth and robust design resulting in a reduction of the mass accumulated as well as an easy cleaning. Also from other points of view the mixer according to the invention will meet high demands with respect to handling and maintenance. The resilient elements, the intermediate bodies 51 are as is evident from the foregoing very easy to change and also the reduction gear is easy to demount.

I claim:

1. A mixer preferably for the mixing of concrete comprising an annular mixing tub having an outer wall and an inner wall defining a mixing space, a rotor means mounted above the center portion of said mixing tub, driving means operably connected to said rotor means for rotating said rotor means, agitating means having a number of agitators carried by said rotor means extending down into said mixing space of the mixing tub, said rotor means comprising a cylindrical case enclosing an inner space, said case extending substantially to said inner wall of said mixing tub and carrying on its periphery a plurality of hollow tubular arms each extending substantially in a radial direction and carrying one of said agitators, said arms being in communication with said inner space of said case, means for connection to a supply of liquid in communication with said inner space of said case, and means for feeding of liquid provided on said agitators, whereby liquid can be fed from said supply to the inner space of said case, to said tubular arms, to said agitators, and to a mixture in said mixing tub.

2. A mixer according to claim 1, wherein a power transmitting device is positioned below said case inside said inner wall of said mixing tub.

3. A mixer according to claim 2, wherein said power transmitting device is arranged to carry said case.

4. A mixer according to claim 1, wherein a frame is arranged on the mixing tub and the case, said frame being divided into sections by means of struts and arranged to support covering elements.

5. A mixer according to claim 1, wherein between each arm and agitator there is provided a resilient element normally holding said agitator in working position and permitting said agitator to pivot when said agitator encounters high resistance.

6. A mixer according to claim 5, wherein said resilient element is made of rubber and has an opening therethrough, said plurality of arms being connected to an additional plurality of hollow tubular arms via said resilient elements, and said additional arms extending to said agitators.

7. A mixer according to claim 1, wherein each agitator comprises means defining an enclosure for fluid, and at least one slit in the edge of said enclosure for the feeding of fluid to the mixture.

* * * * *